United States Patent [19]

Miyano

[11] Patent Number: 4,611,564

[45] Date of Patent: Sep. 16, 1986

[54] ELECTRONICALLY CONTROLLED FUEL INJECTION DEVICE

[75] Inventor: Takashi Miyano, Kanagawa, Japan

[73] Assignee: Mikuni Kogyo Kabushiki Kaisha, Tokyo, Japan

[21] Appl. No.: 683,061

[22] Filed: Dec. 18, 1984

[30] Foreign Application Priority Data

Dec. 21, 1983 [JP] Japan ..... 58-242825

[51] Int. Cl.[4] ..... F02B 3/00

[52] U.S. Cl. ..... 123/478; 123/488

[58] Field of Search ..... 123/488, 478, 399, 369

[56] References Cited

U.S. PATENT DOCUMENTS 3,766,899 10/1973 Isselhorst ..... 123/369
3,916,854 11/1975 Barton ..... 123/369
3,970,065 7/1976 Kaibara ..... 123/369
4,168,679 9/1979 Ikeura ..... 123/399
4,430,975 2/1984 Ishida ..... 123/399
4,470,396 9/1984 Hasumi ..... 123/399

*Primary Examiner*—Ronald B. Cox
*Attorney, Agent, or Firm*—Owen, Wickersham & Erickson

[57] ABSTRACT

An electronically controlled fuel injection or feeding device for use in an internal combustion engine is disclosed. The device comprises means for storing respective engine speeds corresponding to respective positions of an accelerator pedal, and means for increasing the intake mixture of fuel and air to the engine corresponding to the engine speeds by a given amount when a decrease of the actual engine speed is detected under the condition wherein instant pedal position is not changed at a relatively low engine speed.

1 Claim, 7 Drawing Figures

ELECTRONICALLY CONTROLLED FUEL INJECTION DEVICE

BACKGROUND OF THE INVENTION

The present invention relates to an electronically controlled fuel injection device for an internal combustion engine, and more particularly to an electronically controlled gasoline injection device capable of rapidly increasing load at low engine speed in a fuel preference system.

An electronically controlled fuel injector of the fuel preference type (hereinafter referred to as EAC), generally, has a system in which at first the quantity of fuel is determined in accordance with accelerator actuation and then the quantity of air is determined so as to maintain engine operation at an optimum air-fuel ratio. In the EAC system, therefore, since the accelerator pedal stroke (instruction value of engine driving) corresponds to the fuel flow, the stroke is converted into the fuel flow by a certain computer program and the conversion is effected linearly or nonlinearly so that it is possible to obtain different engine responses for an accelerator pedal stroke. FIG. 1 shows one relationship between the accelerator pedal stroke and the fuel flow. In the case of smooth relation as shown in FIG. 1, it is possible to obtain a very suitable feeling with steady speed acceleration and deceleration at light engine load.

However, when it is necessary to increase load rapidly with low engine speed, for example, such as at starting, the magnitude of the accelerator operation becomes large or engine speed, i.e., the rate of engine rotation, becomes low or decreased to the point when a smooth drive feeling cannot be maintained.

SUMMARY OF THE INVENTION

It is an object of the present invention to resolve the above problems associated with a conventional electronically controlled fuel injection device.

It is another object of the present invention to provide an electronically controlled fuel injection device of the EAC type which operates so that when a rapidly increasing engine load occurs, the engine speed does not decrease and the smooth drive feeling can be maintained.

According to the present invention, there is provided an electronically controlled fuel injection device for an internal combustion engine comprising means for storing respective engine speeds corresponding to respective positions of an accelerator pedal, and means for increasing the intake mixture corresponding to the engine speed is detected under the condition wherein instant pedal position is not changed at low engine speed.

The means for storing respective engine speeds is a central processing unit.

According to the present invention, when the engine speed is decreased by a rapid increase of engine load at low engine speed, the quantity of fuel corresponding to the decreased magnitude of engine speed is added to the steady fuel to be injected as an offset magnitude so as to maintain the stroke of the accelerator pedal so that the engine speed can be increased smoothly.

These and other features and advantages of the present invention will become readily apparent from the following detailed description of one embodiment of the present invention, taken in connection with the accompanying drawings wherein like reference numerals designate like or functionally equivalent parts throughout.

DETAILED DESCRIPTION OF THE EMBODIMENT

Figure 1:
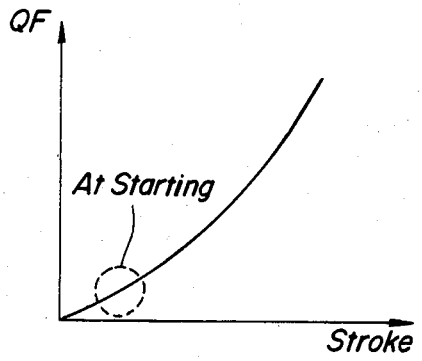
FIG. 1 is a characteristic curve showing a relation between the stroke of an accelerator pedal and the fuel flow of an internal combustion engine.

Referring now to the drawing, there is shown an embodiment of an electronically controlled fuel injection device according to the present invention.

Figure 2:
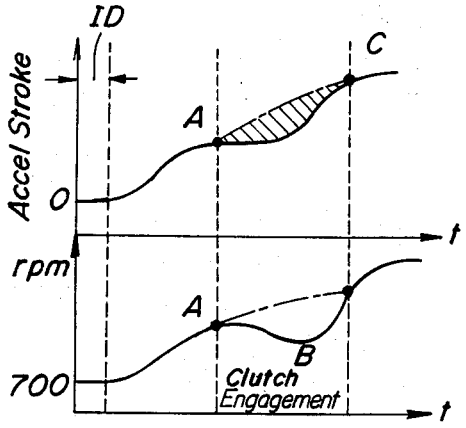
FIG. 2 are characteristic curves illustrating the operation of an accelerator pedal and engine speed (RPM) during a typical clutch meeting as a function of time.

Prior to an explanation of a particular embodiment, the fundamental concept of the present invention will be explained. The will of a driver can be forecast by always sampling a voltage of a potentiometer which converts, by its slide resistance, the position of accelerator pedal i.e., the mechanical stroke of the accelerator pedal into a voltage. If, for example, the accelerator pedal if not returned at starting, it can be decided that the driver expects an increase of engine speed. FIG. 2 shows the operation of an accelerator pedal and the engine speed at a typical clutch meeting as a function of time.

In the EAC type system, the position of the accelerator pedal decides the amount of fuel flow so that the solid line portion of the accelerator pedal stroke shown in FIG. 2 can be substituted by the fuel fuel as it is and thus by the engine power itself.

Assume, that the accelerator pedal position and the engine speed at point A in FIG. 2 are stored in a memory. If the engine speed becomes decreased under the condition of holding the pedal at the position A, it can be considered that engine load becomes large. Under such a condition, therefore, when the quantity of fuel corresponding to the shaded portion shown in FIG. 2 is added for increasing the steady fuel, the engine speed is changed as shown by a dot-dash line to continue smooth rotation so that the accelerator pedal need not be depressed as shown by a point C.

Figure 3:
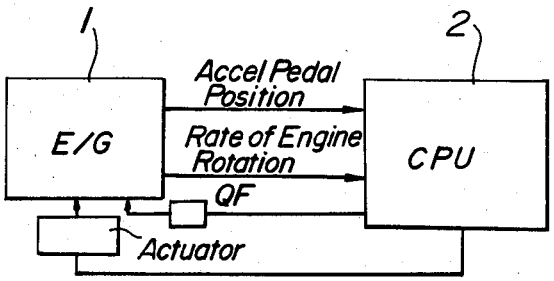
FIG. 3 is a block diagram showing one embodiment of an electronically controlled fuel injection or feeding device according to the present invention.

FIG. 3 shows a construction of an electronically controlled fuel injection or feeling device according to the present invention wherein reference numeral 1 is an internal combustion engine. Numeral 2 is a central processing unit which performs the following arithmetic operation by receiving signals representing accelerator pedal position and engine speed:

$$QFout = QFdesi + QFofset$$

$$QAout = QFout \times A/F$$

wherein QFofset is an increase in the amount of fuel, QFdesi is a quantity of fuel determined by the stroke of the pedal, QFout is the actual outputted fuel quantity, and QAout is an air quantity required for the fuel quantity "QFout" at an air fuel ratio of "A/F".

In practice, QAofset can be calculated by multiplying the value obtained by integrating the engine rotation changes between points A and B by a certain gain.

Figure 4:
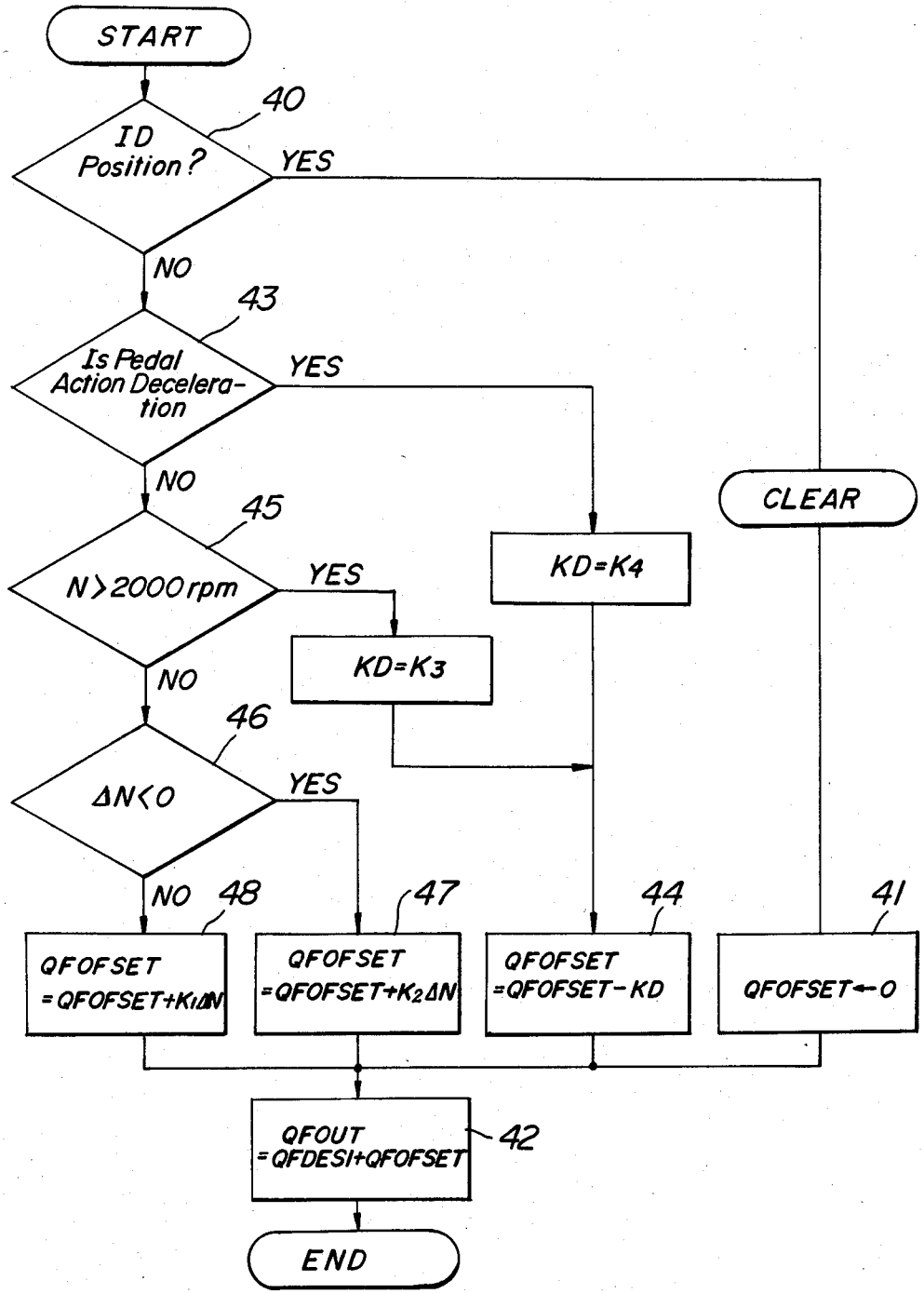
FIG. 4 is a flow chart explaining operating steps of a central processing unit for the device shown in FIG. 3.

FIG. 4 shows a flow chart for explaining the operation of the device according to the present invention. Start for this operation is performed by making it in synchronism with the engine. At first, a step 40 decides whether or not the engine 1 is at the ID (idling) position. When the engine is at the ID position, a step 41 becomes operated thereby making the increase in the amount of fuel zero quickly. That is, the engine 1 is in this condition regardless of acceleration and deceleration of the engine. In this case, therefore, the command value becomes QFout+AFdesi at a step 42. In short, the actually outputted fuel quantity QFout becomes only fuel quantity QFdesi determined by the stroke of the pedal. If the engine is not at the ID position, a step 43 becomes operative to decide whether the pedal operation is at deceleration or not. This detection is performed by comparing the voltage representing engine speed with the voltage obtained by converting the pedal position into a voltage with the use of a slide resistor. The pedal operation comprises the steady speed operation, acceleration operation and deceleration operation. In the case of deceleration, a step 44 becomes operative to decrease the operation amount of offset $KD=K_4$ quickly, since excess amount of fuel is delivered regardless of deceleration when the offset amount of fuel remained from the prior condition. When the engine is not at deceleration in the step 43, it is in the steady state condition or the acceleration condition so that a step 45 becomes operative to detect engine speed. If the step 45 detects more than 2000 rpm of engine speed it seems to be completed for the starting condition, thereby operating the step 44 to decrease the operation amount of offset $KD=K_3$. In this case, the operation amount has a weighted value. If the step 45 detects less than 2000 rpm of engine speed, a step 46 becomes operative to decide the difference $\Delta N$ between the prior engine speed and the instant engine speed. If $\Delta N<0$ the speed becomes slightly increased under the steady speed or acceleration condition so that a step 47 becomes operative to make the operation amount of offset slightly decreased. In this case $K_2\Delta N$ is the amount obtained by taking the speed difference $\Delta N$ and the operation amount $K_2$ into consideration, wherein $K_2>K_3$. If $\Delta N>0$ in the step 46 the engine speed becomes decreased and thus the engine load is increased so that a step 48 becomes operative to generate or output an increased amount of fuel QFofset by adding the amount $K_1\Delta N$ obtained by taking the decreased difference of speed $\Delta N$ and the operating amount $K_1$ to the previous increase amount QFofset, wherein $K_1>K_2$. In this case $K_1$, $K_2$, $K_3$, $K_4$ are constants of operation amount, and the weights are made $K_1>K_2>K_3>0$. In order to prevent an erroneous decision and hunting at a steady driving rate for the operation decision of the accelerator pedal and the decision of speed difference $\Delta N<0$, a deed zone is provided to thereby maintain stability of operation.

Figure 5A:
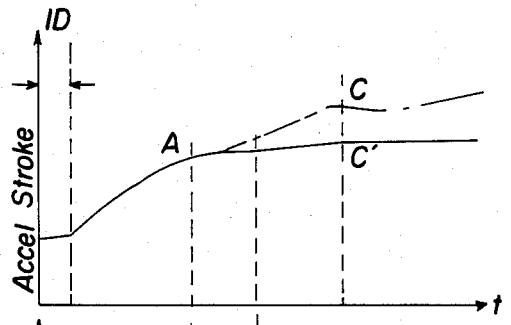
FIGS. 5*a*, 5*b*, and 5*c*, 5*d* and 5*e* are explanatory views illustrating the relationships of accelerator pedal stroke, fuel flow and engine speed, respectively as a function of time.
Figure 5B:
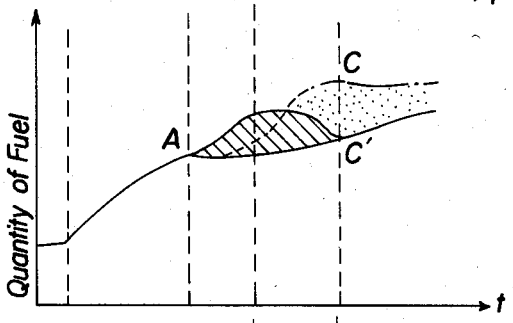
Figure 5D:
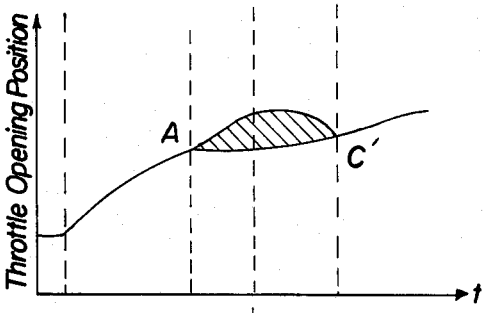
Figure 5E:
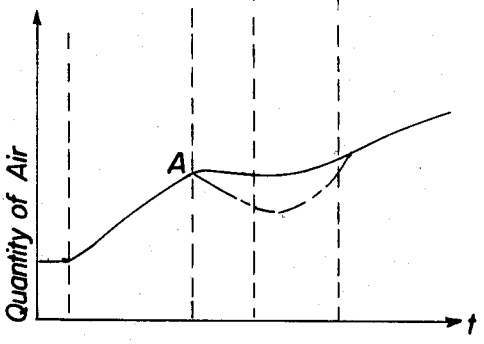
Figure 5C:
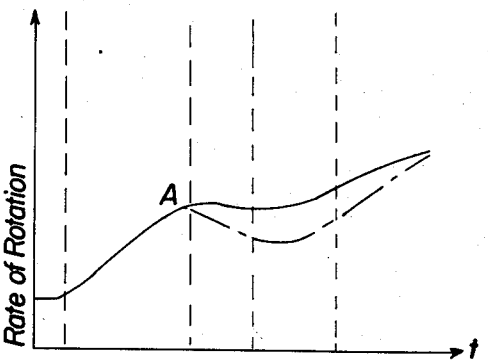

FIGS. 5*a*, 5*b* and 5*c* illustrate the action of the accelerator pedal stroke, the fuel flow and the engine speed, respectively, as a function of time. In FIG. 5, the region from the ID position to a point A is one for making engine speed increase. If clutch meeting occurs at the point A, the engine speed is decreased as an increase of engine load occurs, as shown in FIG. 5*c* (without control), but the engine speed is smoothly increased as shown in FIG. 5*c* without substantially changing the accelerator pedal stroke as shown in FIG. 5*a*, because of the injection of fuel by an increased amount, as shown in FIG. 5*b*. In the case of a conventional system without control, if engine speed is decreased as shown in FIG. 5*c* by the point A, the operation for increasing engine speed by depressing the pedal as shown in FIG. 5*a* is performed so that the fuel amount or quantity is increased, as shown in FIG. 5*b* by the dotted line. After increasing the engine speed, however, the added difference of fuel quantity due to pedal depression becomes wasteful, as shown in FIG. 5*b* by the dot-shaded portion between C and C.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

What is claimed is:

1. An electronically controlled fuel injection device of the fuel preference type for an internal combustion engine comprising:

means for detecting accelerator pedal position;

means for detecting engine speed;

a central processing unit for arithmetically operating respective detected values of the pedal position and the engine speed which are received as input;

the central processing unit comprising:

means for storing engine speed corresponding to the accelerator pedal position;

means for detecting whether the engine is in an idling state or not;

means for detecting whether the present accelerator pedal position is in any one of an acceleration state, a deceleration state or a stationary state;

means for detecting a completion of a starting state in engine operation when the engine operation is in the stationary state or in an acceleration state;

means for determining the difference between the engine speed sampled at a previous time increment and the present sampling engine speed of engine operation; and means for deciding that an increase of load has occurred when the difference of the engine speeds is negative and for increasing the fuel amount by a fuel amount corresponding to the decreased difference of the engine speed by arithmetic operation.

* * * * *